US009765946B2

(12) United States Patent
Hikmet et al.

(10) Patent No.: US 9,765,946 B2
(45) Date of Patent: Sep. 19, 2017

(54) LIGHTING ASSEMBLY FOR PROVIDING A NEUTRAL COLOR APPEARANCE, A LAMP AND A LUMINAIRE

(71) Applicant: PHILIPS LIGHTING HOLDING B.V., Eindhoven (NL)

(72) Inventors: Rifat Ata Mustafa Hikmet, Eindhoven (NL); Ties Van Bommel, Horst (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 132 days.

(21) Appl. No.: 14/395,527

(22) PCT Filed: Apr. 15, 2013

(86) PCT No.: PCT/IB2013/052971

§ 371 (c)(1),
(2) Date: Oct. 20, 2014

(87) PCT Pub. No.: WO2013/160796

PCT Pub. Date: Oct. 31, 2013

(65) Prior Publication Data

US 2015/0077989 A1 Mar. 19, 2015

Related U.S. Application Data

(60) Provisional application No. 61/637,937, filed on Apr. 25, 2012.

(51) Int. Cl.
*G09F 13/04* (2006.01)
*F21V 9/08* (2006.01)
(Continued)

(52) U.S. Cl.
CPC ..... *F21V 9/08* (2013.01); *F21V 3/0481* (2013.01); *F21V 9/16* (2013.01); *F21K 9/232* (2016.08);
(Continued)

(58) Field of Classification Search
CPC . F21V 3/0481; F21V 9/08; F21V 9/16; F21K 9/17; F21Y 2101/00; F21Y 2115/10
See application file for complete search history.

(56) References Cited

U.S. PATENT DOCUMENTS

2006/0291238 A1* 12/2006 Epstein ..... G02B 6/0055 362/600
2008/0101092 A1* 5/2008 Lee ..... G02B 6/0073 362/628
2008/0247172 A1* 10/2008 Beeson ..... F21K 9/00 362/308
2010/0328926 A1 12/2010 Hoelen et al.
(Continued)

FOREIGN PATENT DOCUMENTS

CN CN101203777 A 6/2008
CN 101918757 A 12/2010
(Continued)

*Primary Examiner* — Ali Alavi

(57) ABSTRACT

A lighting assembly 100, a lamp and a luminaire are provided. The lighting assembly 100 comprises a light exit window 114, a light source 110 and a partially light transmitting reflector 102. The light source 110 emits light in at least a first narrow band of the visible spectrum towards the light exit window 114. The partially light transmitting reflector 102 is arranged at the light exit window 114 and reflects substantially all light of the visible spectrum except in at least the first narrow band of the visible spectrum. The partially light transmitting reflector is light transmitting in the first narrow band.

13 Claims, 6 Drawing Sheets

(51) Int. Cl.

| | |
|---|---|
| ***F21V 9/16*** | (2006.01) |
| ***F21V 3/04*** | (2006.01) |
| *F21K 9/232* | (2016.01) |
| *F21K 9/27* | (2016.01) |
| *F21Y 115/10* | (2016.01) |
| *F21Y 113/13* | (2016.01) |

(52) U.S. Cl.
CPC ..... *F21K 9/27* (2016.08); *F21Y 2113/13* (2016.08); *F21Y 2115/10* (2016.08)

(56) References Cited

U.S. PATENT DOCUMENTS

| | | | | |
|---|---|---|---|---|
| 2011/0073898 | A1 | 3/2011 | Van Sprang et al. | |
| 2011/0188846 | A1 | 8/2011 | Sorg et al. | |
| 2011/0291113 | A1 | 12/2011 | Chamberlin | |
| 2012/0001204 | A1 | 1/2012 | Jagt | |
| 2012/0147333 | A1* | 6/2012 | Jorgensen | G03B 33/06 353/31 |
| 2012/0188791 | A1* | 7/2012 | Voloschenko | G02B 5/0252 362/606 |
| 2012/0236537 | A1* | 9/2012 | Pickard | F21K 9/00 362/84 |
| 2013/0208469 | A1* | 8/2013 | Progl | F21V 29/506 362/235 |

FOREIGN PATENT DOCUMENTS

| | | | |
|---|---|---|---|
| CN | 102112799 | A | 6/2011 |
| EP | 1092919 | A2 | 4/2001 |
| WO | 2011109093 | A1 | 9/2011 |

* cited by examiner

LIGHTING ASSEMBLY FOR PROVIDING A NEUTRAL COLOR APPEARANCE, A LAMP AND A LUMINAIRE

CROSS-REFERENCE TO PRIOR APPLICATIONS

This application is the U.S. National Phase application under 35 U.S.C. §371 of International Application No. PCT/IB2013/052971, filed on Apr. 15, 2013, which claims the benefit of U.S. Provisional Application No. 61/637,937, filed on Apr. 25, 2012. These applications are hereby incorporated by reference herein.

FIELD OF THE INVENTION

The invention relates to lighting assemblies having a neutral color appearance.

BACKGROUND OF THE INVENTION

In several lighting assemblies luminescent materials are used to convert a portion of the light emitted by a light emitter towards light of another color to obtain a light emission of a specific color. The luminescent layer is also facing the ambient and, thus, visible to people looking towards the lighting assembly. Especially when the light emitter is not emitting light, the luminescent layer has a colored appearance. Ambient light falls on the luminescent layer and a portion of this ambient light is absorbed and converted to the another color and the light of the another color is emitted back to the ambient. Thus, the combination of the reflected and the emitted light has a color and it seems to a viewer that the luminescent layer has a certain color. Often it is undesired to have such a color appearance because lighting assemblies must be integrated in a specific environment, such as in a luminaire, and must have in such environments a neutral appearance.

Published patent application US2012/0001204 relates to a color adjustment arrangement which reduces the color appearance of a lighting assembly. The color adjustment arrangement comprises an additional luminescent layer which comprises luminescent material that converts absorbed light towards light of a complementary color. The light of the complementary color partly neutralizes the light emitted by the (original) luminescent layer thereby obtaining a less colorful lighting assembly.

In the color adjustment arrangement of the cited document additional luminescent materials are used in an additional layer. Many luminescent materials are relatively expensive. Further, the light emission of the light assembly, in use, is also influenced by the additional luminescent layer and as such the light emission also comprises the complementary color. Such additional colors in the light emission of the lighting assembly are often undesired.

SUMMARY OF THE INVENTION

It is an object of the invention to provide a lighting assembly which has a more neutral color appearance without influencing the light emission of the light emitter of the lighting assembly.

A first aspect of the invention provides a lighting assembly for providing a neutral color appearance. A second aspect of the invention provides a lamp. A third aspect of the invention provides a luminaire. Advantageous embodiments are defined in the dependent claims.

A lighting assembly in accordance with the first aspect of the invention comprises a light exit window, a light source and a partially light transmitting reflector. The light source emits light in at least a first narrow band of the visible spectrum towards the light exit window. The partially light transmitting reflector is arranged at the light exit window and is arranged to reflect substantially all light of the visible spectrum except in at least the first narrow band of the visible spectrum. The partially light transmitting reflector is arranged to be light transmitting in the first narrow band.

At the light exit window, via the partially light transmitting reflector, light is transmitted into the ambient of the lighting assembly. The partially light transmitting reflector allows the transmission of the light emitted by the light source into the ambient because it does not reflect the light in the first narrow band of the visible spectrum, but transmits this light. The color and/or the intensity of the light of the first narrow band are not influenced by the partially light transmitting reflector. Because substantially all other visible light is reflected by the partially light transmitting reflector, ambient light which impinges on the lighting assembly is for the largest part reflected and, thus, the lighting assembly has a neutral color appearance. For a viewer it seems that the back reflected light has the same spectral distribution as the ambient light. The absence of light in the first narrow band in the reflected light does not significantly change the color point of the reflected light because in most common ambient lighting conditions only a limited amount of energy is present in the first narrow band and the reflected light only lacks this light in the first narrow band.

It is to be noted that the term "narrow" means that the Full Width Half Maximum (FWHM) width of the first narrow band is not more than 15% of the whole visible spectral range. In an embodiment, the FWHM of the first narrow band is less than 10% of the visible spectral range. Thus, in other words, in an embodiment, the FWHM of the first narrow band is smaller than 45 nanometers, or in another embodiment, the FWHM of the first narrow band is smaller than 30 nanometers.

Light in the visible spectral range is light which may be seen by the human naked eye. Typically, the visible spectral range starts at wavelengths of about 380 nanometers (violet light) and ends at 800 nanometers (red light).

Further, each suitable type of light source may be used as long as the light emission of the light source is in a narrow band of the visible spectral range. Suitable light sources are discussed in this document, and examples are: Light Emitting Diodes (LEDs), laser diodes, light source provided with quantum dots luminescent material, etc.

Optionally, the lighting assembly comprises a plurality of light emitters for emitting light in a plurality of narrow bands of the visible spectrum. The partially light transmitting reflector is arranged to not reflect light of the plurality of narrow bands of the visible spectrum and is light transmitting in the plurality of narrow bands. Thus, in other words, substantially all impinging ambient light is reflected by the partially light transmitting reflector and, consequently, the lighting assembly has a neutral color appearance. Further the partially light transmitting reflector transmits substantially all the light which is emitted by the light emitters (in so far this light impinges on the partially light transmitting reflector).

Optionally, the light source comprises a light emitter which emits light of a specific color. The light source further comprises luminescent material which absorbs light of the specific color and converts a portion of the absorbed light into light of another specific color. Depending on the specific configuration of the light source all light of the specific color is converted into light of the another specific color and the light of the another color is the light of the first narrow band. It is also possible that not all light emitted by the light emitter is converted towards light of the another specific color, and that the light of the specific color is light of the first narrow band. In this last situation the light of the specific another color is light of a second narrow band of the visible spectrum and the partially light transmitting reflector does not reflect light of first and of the second narrow bands and is light transmitting in the first and second narrow band. The partially light transmitting reflector prevents that the color of the luminescent material of the light source is well visible to a viewer who looks towards the lighting assembly.

Optionally, the luminescent material comprises a material showing quantum confinement and is at least in one dimension nano sized. Luminescent material like Quantum dots, quantum rods, wires tetrapod show quantum confinement, which means that they have size dependent optical properties. The materials are nano sized, which meant that in at least one dimension their size is in the range from 0.5 nanometer to 100 nanometer, or, in another embodiment, in the range from 1 nanometer to 30 nanometer. Such material have, in general, a relatively narrow light emission spectrum which has, for example a width of 20 nanometer FWHM. Such materials are well suitable for use in the lighting assembly of the invention because the partially light transmitting reflector needs to be light transmitting in only a narrow band of the visible spectrum to transmit the light generated by these luminescent materials.

Optionally, the partially light transmitting reflector comprises a dichroic filter. Dichroic filter only pass a well-defined range of colors while other colors are reflected. By use of one or more dichroic filter(s), the partially light transmitting reflector may be configured such that only the light of the first narrow band is transmitted through the partially light transmitting reflector while other light is reflected. Instead of dichroic filter, the term "notch filter" is often used.

Optionally, the partially light transmitting reflector comprises a dichroic mirror. A dichroic mirror reflects light in a well-defined band of the visible spectrum and allows the transmission of light at other wavelengths than the wavelengths of the band. Thus, several dichroic mirrors can be combined together and/or combined with a dichroic filter to manufacture the partially light transmitting reflector which allows the transmission of light in one or more narrow band(s), while reflecting light at wavelengths outside these one or more narrow band(s).

Optionally, the partially light transmitting reflector comprises a plurality of dichroic filters.

Optionally, the partially light transmitting reflector comprises a stack of alternating optical layers wherein the refractive indices of two neighboring layers are different from each other. By designing a specific stack of alternating layers wherein the different layers have a different, well defined, thickness, a partially light transmitting reflector can be obtained which is light transmitting in one or more bands of the visible spectrum and is reflecting in other bands of the visible spectrum. At each interface between neighboring layers portions of light of specific wavelengths are reflected and specific patterns of interference between different waves may be obtained which result in the specific transmission and reflection characteristic of the stack. By means of simulation and careful design a suitable stack of alternating optical layers may be designed. The alternating layers may be made of glass, polymer compositions, organic material, etc. Other terms that are often used for such partially light transmitting reflectors are "interference filter" or "thin-film filter". From 3M ESR filters can be obtained which have a similar structure.

Optionally, the partially light transmitting reflector comprises a surface facing away from the light source. The surface is diffusely reflective. Thus, the surface is the surface which faces the ambient and which is seen by a person looking towards the lighting assembly. This specific surface is diffusely reflective and, thus, has an even more neutral appearance than a lighting assembly with a specular reflective surface (which has the appearance of a mirror or has a more shining/glittering/sparkling appearance). It is noted that the invention is not limited to lighting assembly with such a diffusely reflective surface—the surface may, in another optional embodiment, be specular reflective as well.

Optionally, the partially light transmitting reflector comprises a surface facing away from the light source. The lighting assembly further comprises a diffusing layer provided on the surface of the partially light transmitting reflector. Thus, the appearance of the surface which faces the ambient and which is seen by a viewer is not shining/glittering or sparkling, but is more neutral. The surface gets an appearance similar to a white or color neutral sheet of paper as the result of the use of the diffusing layer. Further, light transmitted through the partially light transmitting reflector is diffused, which results in a light emission in a multitude of directions. Often a diffuse light emission is required because it provides a more uniform lighting of an environment.

Optionally, the diffusing layer diffuses the light up to a limited extent. The light, which is transmitted through the partially light transmitting reflector, is emitted in a specific light emission angular distribution (a distribution of light intensity at angles of light emission with respect to a central axis of the emitted light beam) which has a certain width measured at Full Width Half Maximum (FWHM). The diffusing up to the limited extent increases the width of the FWHM with not more than 20 degrees.

According to a second aspect of the invention, a lamp is provided which comprises a lighting assembly according to a first aspect of the invention.

According to a third aspect of the invention, a luminaire is provided which comprises a lighting assembly according to the first aspect of the invention or comprises a lamp according to the second aspect of the invention.

The lamp according to the second aspect of the invention and the luminaire according to the third aspect of the invention provide the same benefits as the lighting assembly according to the first aspect of the invention and have similar embodiments with similar effects as the corresponding embodiments of the lighting assembly.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the assembly, the lamp and/or the luminaire, which correspond to the described modifications and variations of the assembly, can be carried out by a person skilled in the art on the basis of the present description.

Figure 1A:
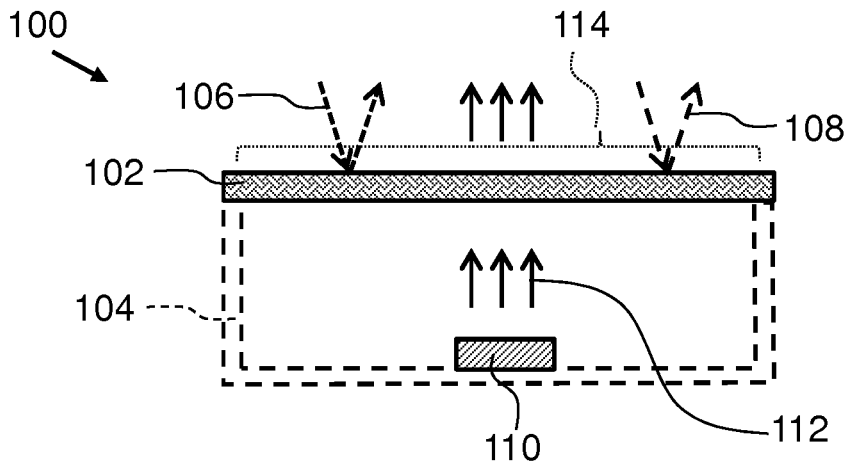
FIG. 1*a* schematically shows, in a cross-sectional view, an example of a lighting assembly according to the first aspect of the invention, FIG. 1*b* schematically shows a light emission spectrum of a light source and a reflectivity profile of a partially light transmitting reflector, FIG. 2*a* schematically shows, in a cross-sectional view, another example of a lighting assembly, FIG. 2*b* schematically shows three light emission spectra of three different light sources and a reflectivity provide of another partially light transmitting reflector, FIG. 3 schematically shows a plurality of examples of a lighting assembly in a cross-sectional view, FIG. 4*a* schematically shows, in a cross-sectional view, a partially light transmitting reflector including reflectivity profiles of independent layers of the partially light transmitting reflector, FIG. 4*b* schematically shows another example of a light transmitting reflector in a cross-sectional view, FIG. 5*a* schematically shows, in a cross-sectional view, a retrofit light-tube according to the second aspect of the invention, FIG. 5*b* schematically shows, in a cross-sectional view, a retrofit lamp according to the second aspect of the invention, and FIG. 6 schematically shows a luminaire according to the third aspect of the invention.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

A first embodiment is shown in FIG. 1*a*. FIG. 1*a* schematically shows, in a cross-sectional view, an example of a lighting assembly 100 according to the first aspect of the invention. The lighting assembly 100 comprises a light source 110, a light exit window 114 and a partially light transmitting reflector 102. In FIG. 1*a* a housing 104 of the lighting assemble is drawn by a dashed line. The housing 104 is an optional feature of the lighting assembly—it is not important which particular housing is used for housing the light source 110 and for supporting the partially light transmitting reflector 102, it is only important that there is a light exit window, for example, a light exit window 114 of a housing 104. In another embodiment, the light exit window may also be an opening of a recess. The housing 104 which is schematically indicated in FIG. 1*a* may have box shape which has a base on which the light source 110 is provide and has walls in between the light exit window 114 and the base. The light source 110 emits light 112 in at least a first narrow band of the visible spectrum and the light 112 is emitted towards the light exit window 114. A partially light transmitting reflector 102 is arranged at the light exit window 114. The partially light transmitting reflector 102 is for the largest part of the visible spectrum light reflective and is light transmitting in at least one narrow band that is substantially equal to the first narrow band in which light is emitted by the light source 110. This means that light 112 which is emitted by the light source 110 is transmitted through the partially light transmitting reflector into the ambient of the lighting assembly 100, and that ambient light, such as light 106, 108 is reflected by the partially light transmitting reflector 102.

Figure 1B:
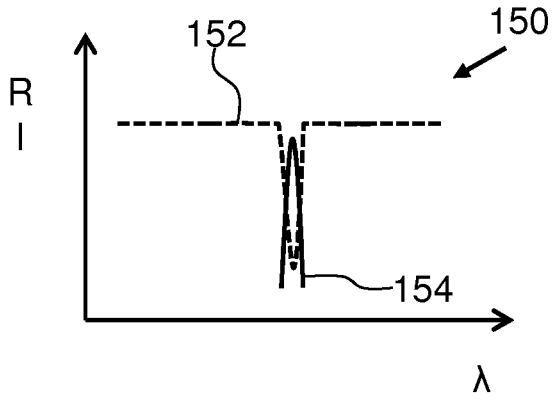

FIG. 1*b* schematically presents a chart 150 in which a light emission spectrum 154 of the light source 110 is presented together with a reflectivity profile 152 of the partially light transmitting reflector 102. The x-axis represents the wavelength λ of visible light. The y-axis represents, respectively, the emitted light intensity I at specific wavelengths λ and the relative amount of reflected light R at specific wavelengths λ. The light emission spectrum 154 is relatively narrow, which means that the Full Width Half Maximum (FWHM) value of the light emission spectrum 154 is smaller than 60 nanometer, in another optional embodiment smaller than 40 nanometer and yet in another embodiment smaller than 25 nanometer. The reflectivity profile 154 of the partially light transmitting reflector 102 is substantially flat at almost all wavelengths of the visible spectrum and only at the wavelengths of the visible spectrum at which the light source 110 emits light the reflectivity profile 152 has a dip, which means that the wavelengths of the light emission spectrum 154 are not reflected. The light transmission profile (not shown) of the partially light transmitting reflector 102 is similar to the inverse of the reflectively profile 152, which means that the light transmission profile is similar to the light emission spectrum 154 of the light source 110. Thus, light with wavelengths in the light emission spectrum 154 are not reflected by the partially light transmitting reflector 102 and are transmitted through the partially light transmitting reflector 102.

It is noted that the reflectivity profile 152 is drawn substantially flat and has at most wavelengths a reflectivity close to 100%. The drawn reflectively profile 152 is a schematic representation and, in practical embodiments, the reflectivity may be slightly lower and may slightly vary along the visible spectrum. The reflectivity is at least 80%, and in another embodiment, the reflectivity is at least 90%. Further, the light which is transmitted through the partially light transmitting reflector 102 in the narrow band of the light emission spectrum 154 may be subject to limited amount of absorption.

If the partially light transmitting reflector reflects most of the light of the visible spectrum, the surface of the partially light transmitting reflector has a neutral color for a viewer. While being reflected, the distribution of the ambient light is not changed and, thus, it seems for a viewer that the surface is not very colorful and may even appear white (if the partially light transmitting reflector is diffusely reflective)—the surface may also look like a mirror which does not alter the color of the reflections (if the partially light transmitting reflector is specular reflective).

Figure 2A:
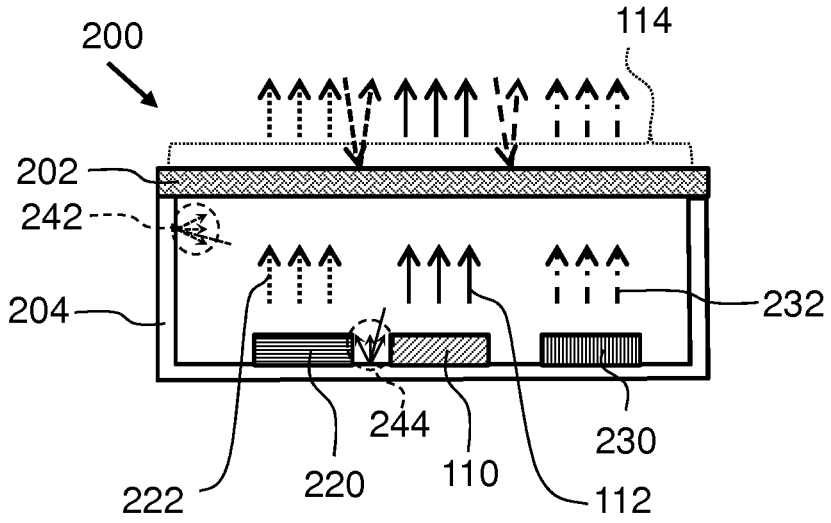
Figure 2B:
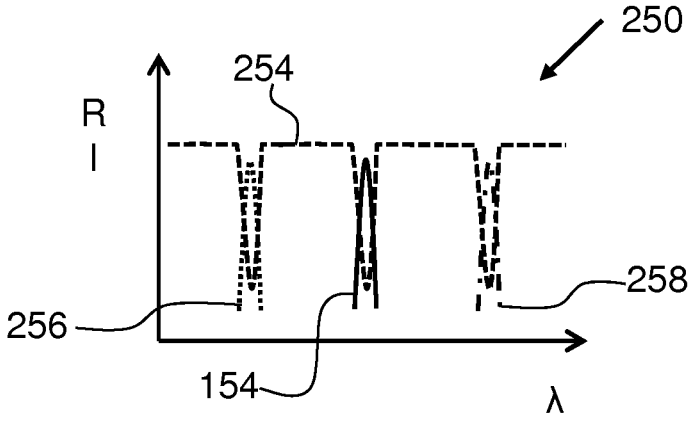

FIG. 2*a* schematically shows, in a cross-sectional view, another example of a lighting assembly 200. FIG. 2*b* schematically shows three light emission spectra 154, 256, 258 of three different light sources 110, 220, 230 and a reflectivity profile 254 of another partially light transmitting reflector 202. The lighting assembly 200 comprises the three light sources 220, 110, 230. Each light source 220, 110, 230 emits light in a narrow light emission band. The three narrow light emission bands may overlap, partially overlap or may be disjunct. Light source 110 emits light 112 in the same narrow light emission band 154 as discussed in the context of FIGS. 1*a*/1*b*. Light source 220 emits light 222 in another light emission band 256 and light source 230 emits light 232 in a further light emission band 258. The light emission bands 154, 256, 258 are narrow which mean that their FWHM are smaller than 60 nanometer, or, in an optional embodiment smaller than 40 nanometers, or in yet another optional embodiment, smaller than 25 nanometers.

The lighting assembly 200 further comprises a housing 204 which has a light exit window 114 and a partially light transmitting reflector 202. The interior of the housing 204 forms a light mixing chamber. The base of the light mixing chamber and the walls are diffusely light reflective as schematically indicated at positions 242, 244. If light impinges on these walls and base, the light is reflected in a plurality of directions. The light sources 110, 220, 230 are provided at the base of the light mixing chamber and are arranged to emit light towards the light exit window 114. The partially light transmitting reflector 202 is arranged at the light exit window 114. The partially light transmitting reflector 202 transmits the light 112, 222, 232 emitted by the light sources 110, 220, 230 and reflects substantially all other visible light. It is to be noted that, in an advantageous embodiment, the walls and the base of the light mixing chamber have a reflectivity of more than 80%, or even more than 90%. Such reflection values for the base and the walls improve the efficiency of the lighting assembly 200 because light which is not directly emitted towards the partially light transmitting reflector 202 or is being reflected at some location, is recycled via one or more reflections such that it can still be transmitted into the ambient.

Different types of light sources 110, 220, 230 may be used. In an example the light sources are Light Emitting Diodes (LEDs) which each emit light in another light emission band. In another example, one or more of the light source 110, 220, 230 are a laser diode. In an example, the light sources 110, 220, 230 are a blue light emitting LED, a red light emitting LED and a green light emitting LED. Other combinations of LEDs are also possible and other combinations of colors of light fall also within the scope of the invention. For example, when four light sources are used, each one of the light sources emits one of the four colors red, green, blue and amber.

In FIG. 2*b* a chart is shown in which the light emission spectra 154, 256, 258 of the light sources 110, 220, 230 and the reflection profile 254 of the partially light transmitting reflector 202 are shown. The x-axis represents the wavelength λ of visible light. The y-axis represents the emitted light intensity I at specific wavelengths λ and the relative amount of reflected light R at specific wavelengths λ. As discussed before, the light emission spectra 154, 256, 258 are relatively narrow. The reflection profile 254 of the partially light transmitting reflector 202 has a relatively large reflection value (between 80% and 100%) for most of the wavelengths of the visible light and only for wavelengths of the in the light emission spectra 154, 256, 258, the reflection value is relatively low and the partially light transmitting reflector 202 has a high transmission value (between 80% and 100%) which means that almost all light emitted towards the partially light transmitting reflector 202 are transmitted through the partially light transmitting reflector 202. As shown in FIG. 2*a*, light 112, 222, 232 emitted by, respectively, light source 110, 220, 230 is transmitted into the ambient, and ambient light at other wavelengths is reflected by the partially light transmitting reflector 202. FIG. 2*b* does not present the light transmission profile of the partially light transmitting reflector 202, but the light transmission profile is substantially equal to the inverse of the reflection profile 254.

It is to be noted that if reflectivity and transmission percentages are mentioned in this document, the percentages are a fraction of light of a specific wavelength, or, they represent a fraction of the total amount of light available in a specific light emission according to a specific light distribution. For example, if the partially light transmitting reflector 202 has to transmit at least 80% of the light of the first narrow band, it has to transmit at least 80% of all the light present in the first narrow band.

Figure 3:
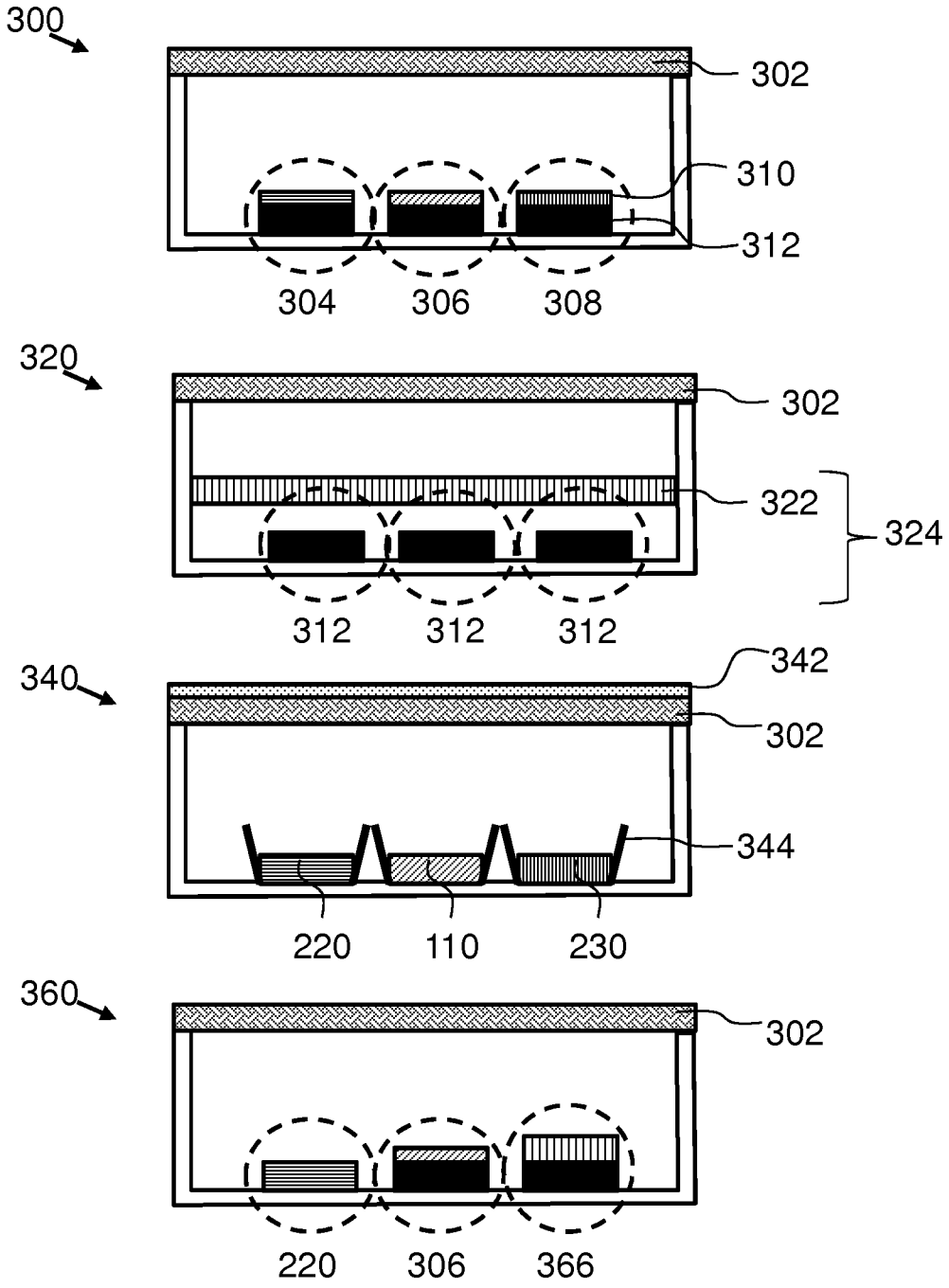

FIG. 3 schematically shows a plurality of examples of a lighting assembly 300, 320, 340, 360 in a cross-sectional view. Lighting assembly 300 is similar to lighting assembly 200, however, the light sources 304, 306, 308 are different from the light sources 110, 220, 230. The light source 304, 306, 308 all comprise a Light Emitting Diode (LED) 312 which is drawn as a black rectangle. All LEDs 312 may be equal, or they may be different. For example, they all may emit blue light, or they may emit different colors of light. On top of the LEDs 312 is provided a light conversion layer 310 which comprises a luminescent material which absorbs light emitted by the LED 312 and converts a portion of the absorbed light towards light of another color. The light of the another color is emitted in a relatively narrow band of the visible light spectrum. The lighting assembly 300 has three light sources 304, 306, 308 which each emit light in a different relatively narrow band of the visible light spectrum. Each light source 304, 306, 308 comprises a light conversion layer 310, and the different light conversion layers 310 of the different light sources 304, 306, 308 comprises a different luminescent material to obtain the different relatively narrow light emissions of the visible light spectrum. In an embodiment, at least one of the luminescent materials shows quantum confinement, which means that the particles have optical properties that depend on the size of the particles. The materials are nano sized, which meant that in at least one dimension their size is in the range from 0.5 nanometer to 100 nanometer, or, in another embodiment, in the range from 1 nanometer to 30 nanometer. Such materials have, in general, a relatively narrow light emission spectrum which has, for example a width of 20 nanometer FWHM. Luminescent materials which show quantum confinement are, for example, Quantum dots, quantum rods, wires tetrapods. In particular these materials have a relatively narrow light emission band. Other suitable luminescent materials, such as organic or inorganic phosphors may be used as well. The partially light transmitting reflector 302 differs from partially light transmitting reflector 202 that it has been configured to transmit light emitted by the light sources 304, 306, 308 and reflect all other light in the visible range.

Lighting assembly 320 is similar to lighting assembly 300. In lighting assembly 300, the light sources were individual configurations of a LED 312 and a luminescent layer, in lighting assembly 320 one light source 324 is provided which comprises a plurality of LEDs 312 which emit light towards a luminescent layer 322 which comprises one or more luminescent material for absorbing light emitted by the LEDs and converting a portion of the absorbed light towards light of one or more other colors. The light emissions of the one or more luminescent materials are in one or more relatively narrow light emission bands in the visible light spectrum. The luminescent materials may be arranged as a mix in the luminescent layer 322, but, in an alternative embodiment, the single luminescent materials may also be provided in spatial separated areas of the luminescent layer 322. It is to be noted that partially light transmitting reflector 302 of lighting assembly 320 is configured to transmit the light which is emitted by the luminescent layer 322 and to reflect light of other wavelengths in the spectrum of visible light. Suitable luminescent materials have been discussed above.

Lighting assembly 340 is similar to lighting assembly 200 of FIG. 2*a*. The only differences are the use of additional optional optical elements. The presented additional optional optical elements may be used in combination with each other, or used separately, and they may be combined with any one of the embodiment of the lighting assemblies presented in the application.

The light source 110, 220, 230 are provided with a reflector 344 for reflecting the light in a specific shaped light beam towards the partially light transmitting reflector 302. This may prevent that light impinges on the walls of the housing. It may further result in a specific shape for the light beam emitted by the lighting assembly 340 as long as the partially light transmitting reflector 302 does not scatter the light. The reflector 344 functions as a means for collimating the light beam. The emission of a collimated light beam is in many practical application required, for example, when the lighting assemblies according to this invention are used in a luminaire for lighting a desk. Alternatively, the lighting assembly 340 may also be provided with a collimating film on top of the partially light transmitting reflector 302 wherein such a collimating film comprises micro sized collimating structures for collimating the light—an example of a micro sized collimating structure is a micro prism.

A further optical element is the diffusing layer 342 which is provided on top of the partially light transmitting reflector 302. The diffusing layer 342 diffuses the light which is transmitted through the layer 342. Thus, the light which is reflected by the partially light transmitting reflector 302 is diffused twice and the light transmitted through the partially light transmitting reflector 302 is diffused once. Consequently, the appearance of the lighting assembly is matte instead of, for example, specular reflective. In an embodiment, the diffusing layer 342 diffuses the light up to a limited extends. For example, light that impinges on one side of the layer with a specific angular light intensity distribution is only diffused such that the FWHM of the angular light intensity distribution only increases with 30 degrees, or in another embodiment, only with 20 degrees.

The characteristics of the partially light transmitting reflector 302 are not significantly different. It is only important that the partially light transmitting reflector 302 transmits the light emitted by the light source 110, 220, 230 and reflects other light in the visible light spectral range.

The lighting assembly 360 only differs from the previous embodiments of the lighting assemblies that different combinations of light sources are used. For example, light source 220 is a LED emitting light in a first relatively narrow light emission band. Light source 306 is a LED combined with a color conversion layer, such as discussed in the embodiment of the lighting assembly 300. In an embodiment, the light source 366 is a LED with a luminescent layer which comprises a mix of luminescent materials. In another embodiment, the light source 366 is a laser diode.

Figure 4A:
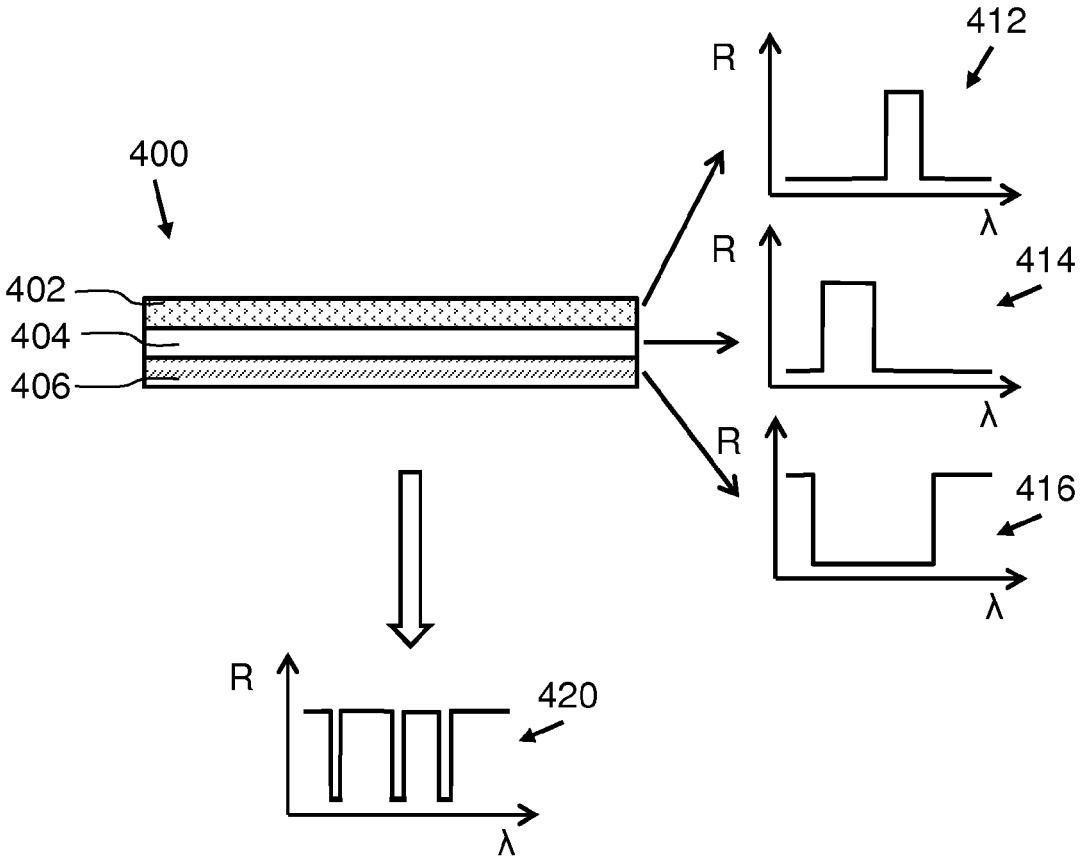

FIG. 4*a* schematically shows, in a cross-sectional view, a partially light transmitting reflector 400 including reflectivity profiles 412, 414, 416 of layers 402, 404, 406 of the partially light transmitting reflector. The partially light transmitting reflector 400 comprises three different layers 402, 404, 406. In other embodiments, the number of layers may vary in dependence of the specific required characteristics of the partially light transmitting reflector 400. Layer 402 is, for example, a dichroic mirror which only reflects light in a first relatively small band of the visible spectral range and transmits light outside this first relatively small band, such as shown in reflection profile 412. Layer 404 is a another dichroic mirror which only reflects light in a second relatively small band of the visible spectral range and transmits light outside this second relatively small band, such as shown in reflection profile 414. Layer 406 is a dichroic filter which transmits light in well-defined band of the visible spectral range and which reflects light outside this band. The shown reflectivity profile 416 is of dichroic filter 406. The combination of the three layer 402, 404, 406 results in a reflectively profile 420 of the partially light transmitting reflector 400 which is shown at the bottom of FIG. 4*a*. Thus, by combining specific dichroic mirrors and specific dichroic filters almost every partially light transmitting reflector 400 can be manufactured.

Figure 4B:
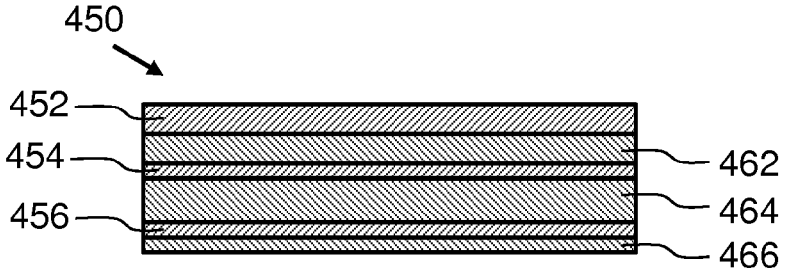

FIG. 4*b* schematically shows in a cross-sectional view another embodiment of a partially light transmitting reflector 450. The partially light transmitting reflector 450 comprises a stack of layers 452 . . . 466 in which layers of two different materials alternate. A first material has a first refractive index and the second material has a second refractive index which is different from the first refractive index. Layers 452 . . . 456 are of the first material and layers 462 . . . 466 are of the second material. Further, the layers have different thicknesses. By carefully choosing the materials with the different refractive indices and carefully choosing the thicknesses of the successive layers 452 . . . 466 a reflectivity and transmission profile may be created in accordance with the requirements for the partially light transmitting reflector 450 used in a specific lighting assembly. By means of simulation programs the skilled person can find a stack of layers 452 . . . 466 which suits its use. By designing a specific stack of alternating layers wherein the different layers have a different, well defined, thickness, a partially light transmitting reflector can be obtained which is light transmitting in one or more narrow bands of the visible spectrum and is reflecting in other bands of the visible spectrum. At each interface between neighboring layers portions of light of specific wavelengths are reflected and specific patterns of interference between different waves may be obtained which result in the specific transmission and reflection characteristic of the stack of layers 452 . . . 466. The alternating layers may be made of glass, polymer compositions, organic material, etc. Other terms that are often used for such partially light transmitting reflectors are "interference filter" or "thin-film filter". From 3M ESR filters can be obtained which have a similar structure.

Figure 5A:
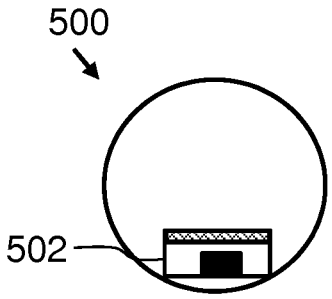

FIG. 5*a* schematically shows, in a cross-sectional view, a retrofit light-tube 500 according to the second aspect of the invention. The retrofit light-tube 500 comprises one or more lighting assemblies 502 according to the first aspect of the invention. Instead of retrofit light-tube, the term LED TL replacement tube may also be read.

Figure 5B:
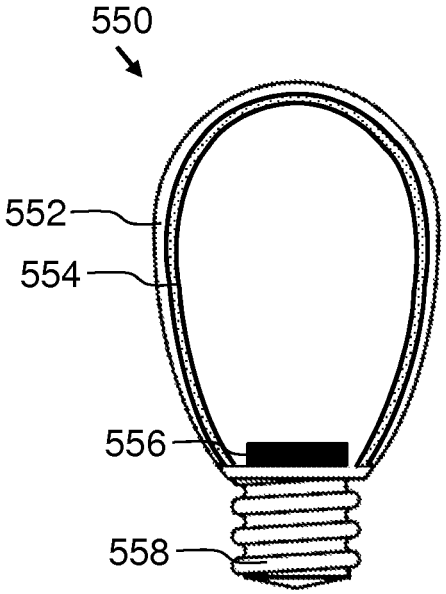

FIG. 5*b* schematically shows, in a cross-sectional view, a retrofit lamp 550 according to the second aspect of the invention. The retrofit lamp 550 comprises a base 558 to which a light bulb 552 of glass is provided. The light bulb 552 may be diffusely reflective. At the base 558 is provided a LED 556 (or LED with one or more luminescent layers) which emits light towards the light bulb 552. The light emission of the LED 556 is in at least one relatively narrow light band of the visible spectral range. At the inner surface of the light bulb 552 is provided a partially light transmitting reflector 554 in accordance with the characteristics of the first aspect of the invention.

Figure 6:
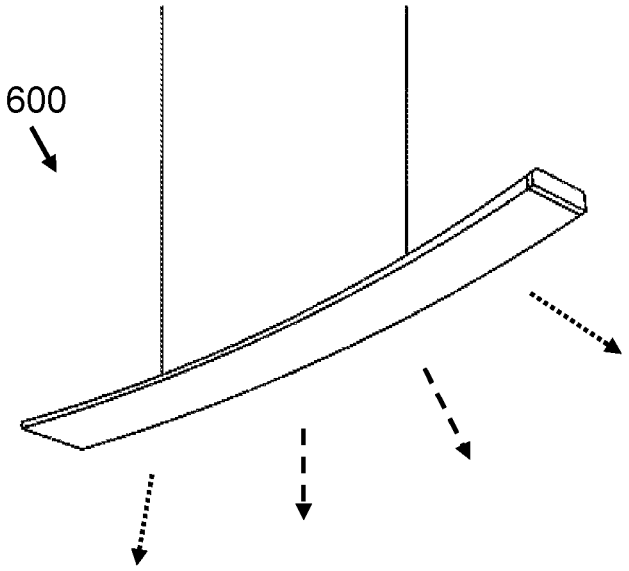

FIG. 6 schematically shows a luminaire 600 according to the third aspect of the invention. The luminaire 600 comprises one or more lighting assemblies (not shown) according to the first aspect of the invention or one or more lamps (not shown) according to the second aspect of the invention.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting assembly for providing a neutral color appearance, the lighting assembly comprising a light exit window, a light source for emitting light in at least a first narrow band of the visible spectrum towards the light exit window, a partially light transmitting reflector configured to provide a neutral color appearance and arranged at the light exit window, the partially light transmitting reflector arranged to reflect substantially all light of the visible spectrum except in at least the first narrow band of the visible spectrum, the partially light transmitting reflector is arranged to be light transmitting in the first narrow band of the visible spectrum, wherein the partially light transmitting reflector comprises a surface facing away from the light source, the surface is diffusely reflective.

2. A lighting assembly according to claim 1, wherein the lighting assembly comprises a plurality of light sources for emitting light in a plurality of narrow bands of the visible spectrum and the partially light transmitting reflector is arranged to not reflect light of the plurality of narrow bands of the visible spectrum and is arranged to be light transmitting in the plurality of narrow bands of the visible spectrum.

3. A lighting assembly according to claim 1, wherein the light source comprises a light emitter for emitting light of a specific color and comprises luminescent material for absorbing light of the specific color and converting a portion of the absorbed light into light of another specific color.

4. A lighting assembly according to claim 3, wherein the luminescent material comprises a material showing quantum confinement and has at least in one dimension a size in the nanometer range.

5. A lighting assembly according to claim 1, wherein the partially light transmitting reflector comprises a dichroic filter.

6. A lighting assembly according to claim 1, wherein the partially light transmitting reflector comprises a dichroic mirror.

7. A lighting assembly according to claim 6, wherein the partially light transmitting reflector comprises a plurality of dichroic mirrors.

8. A lighting assembly according to claim 1, wherein the partially light transmitting reflector comprises a stack of alternating optical layers wherein the refractive indices of two neighboring layers are different from each other.

9. A lamp comprising the lighting assembly according to claim 1.

10. A lamp according to claim 9 comprising a light exit layer of glass wherein the partially light transmitting reflector is arranged at one of the surfaces of the light exit layer of glass.

11. A lighting assembly according to claim 1, wherein the light source is one of a Light Emitting Diode (LED) or laser diode.

12. Luminaire comprising the lighting assembly according to claim 1.

13. A lighting assembly for providing a neutral color appearance, the lighting assembly comprising:

a light exit window, a light source for emitting light in at least a first narrow band of the visible spectrum towards the light exit window, a partially light transmitting reflector configured to provide a neutral color appearance and arranged at the light exit window, the partially light transmitting reflector arranged to reflect substantially all light of the visible spectrum except in at least the first narrow band of the visible spectrum, the partially light transmitting reflector is arranged to be light transmitting in the first narrow band of the visible spectrum, wherein the partially light transmitting reflector comprises a surface facing away from the light source, and a diffusing layer provided on the surface of the partially light transmitting reflector.

* * * * *